US012484724B2

(12) United States Patent
Stuhl et al.

(10) Patent No.: US 12,484,724 B2
(45) Date of Patent: Dec. 2, 2025

(54) MUG WITH INTERCHANGEABLE RIMS

(71) Applicants: Aron Stuhl, Brooklyn, NY (US); Nechemya Stuhl, Brooklyn, NY (US)

(72) Inventors: Aron Stuhl, Brooklyn, NY (US); Nechemya Stuhl, Brooklyn, NY (US)

( * ) Notice: Subject to any disclaimer, the term of this patent is extended or adjusted under 35 U.S.C. 154(b) by 415 days.

(21) Appl. No.: 18/152,196

(22) Filed: Jan. 10, 2023

(65) Prior Publication Data

US 2023/0225530 A1 Jul. 20, 2023

Related U.S. Application Data

(60) Provisional application No. 63/266,908, filed on Jan. 19, 2022.

(51) Int. Cl.
*A47G 19/22* (2006.01)

(52) U.S. Cl.
CPC ..... *A47G 19/2227* (2013.01)

(58) Field of Classification Search
CPC ... A47G 19/2227; A47G 19/2205; A45F 3/16; A45F 3/18; B65D 21/08; B65D 21/083; B65D 21/086
See application file for complete search history.

(56) References Cited

U.S. PATENT DOCUMENTS 6,116,439 A * 9/2000 Yaniv ..... B65D 11/04 215/11.1
10,005,608 B1 * 6/2018 Jacob ..... A47G 23/0266
2010/0200438 A1 * 8/2010 Davies ..... B65D 81/3205 220/4.27
2011/0204048 A1 * 8/2011 Carino ..... B65D 21/083 220/4.03
2018/0042417 A1 * 2/2018 Brown ..... A47G 19/2227

* cited by examiner

*Primary Examiner* — Javier A Pagan
(74) *Attorney, Agent, or Firm* — Tatonetti IP

(57) ABSTRACT

A mug having interchangeable rims is implemented in which the user can alternate and customize the mug's rims and, thereby, the exterior aesthetic appearance of their mug. The mug includes a reservoir body that holds a given beverage, such as coffee, tea, water, etc. The reservoir body is adapted with upper threads and lower threads that mate with corresponding threads on rims. For example, a bottom rim has threads that mate with the lower threads, and a top rim has threads that mate with the upper threads. The various components of the mug may be comprised of one or more various materials, such as plastic, metal, or other suitable polymers that can function as discussed herein. The interchangeable rims concept herein can apply to other types of drinking cups, such as wine glasses, beer mugs, children's cups, etc.

6 Claims, 4 Drawing Sheets

Section A-A

MUG WITH INTERCHANGEABLE RIMS

CROSS-REFERENCES TO RELATED APPLICATIONS

This Non-Provisional Patent application claims the benefit of and priority to U.S. Provisional Patent Application Ser. No. 63/266,908, filed Jan. 19, 2022, entitled "Mug with Interchangeable Rims," the entire contents of which is hereby incorporated herein by reference.

BACKGROUND

Tumbler mugs are often used on the go for users to carry their coffee, tea, water, or other beverages. While mugs are primarily functional devices to carry around users' beverages, that does not mean they cannot serve as a form of self-expression.

SUMMARY

A mug having interchangeable rims is implemented in which the user can alternate and customize the mug's rims and, thereby, the exterior aesthetic appearance of their mug. The mug includes a reservoir body that holds a given beverage, such as coffee, tea, water, etc. The reservoir body is adapted with upper threads and lower threads that mate with corresponding threads on rims. For example, a bottom rim has threads that mate with the lower threads, and a top rim has threads that mate with the upper threads. The various components of the mug may be comprised of one or more various materials, such as plastic, metal, or other suitable polymers that can function as discussed herein. Some components may be comprised of or include a rubber or silicone material that provides additional support or protection to various components or provides a design alternative, such as to the rims. Furthermore, the interchangeable rims concept herein can apply to other types of drinking cups, such as wine glasses, beer mugs, children's cups, etc., and the disclosure herein is not limited to any particular type or style of cup.

Once the top rim is secured to the reservoir body, a lid can be secured to the top rim. Since the top rim threads on an outside portion of the reservoir body's threads, the lid secures to the inside portion of the reservoir body and may be adapted like a press-fit mechanism. Other connection methods between the rims and reservoir body are also possible, such as a press-fit mechanism, tab and notch, locking mechanism that releases at the press of a button, and magnets etc. For example, the rims may be magnetized by implanting one or more magnets within its body which attract to corresponding magnets where the threads on the reservoir body are located.

This Summary is provided to introduce a selection of concepts in a simplified form that is further described below in the Detailed Description. This Summary is not intended to identify key features or essential features of the claimed subject matter, nor is it intended to be used as an aid in determining the scope of the claimed subject matter. Furthermore, the claimed subject matter is not limited to implementations that solve any or all disadvantages noted in any part of this disclosure. These and various other features will be apparent from reading the following Detailed Description and reviewing the associated drawings.

BRIEF DESCRIPTION OF THE DRAWINGS

Like reference numerals indicate like elements in the drawings. Elements are not drawn to scale unless otherwise indicated.

DETAILED DESCRIPTION

Figure 1:
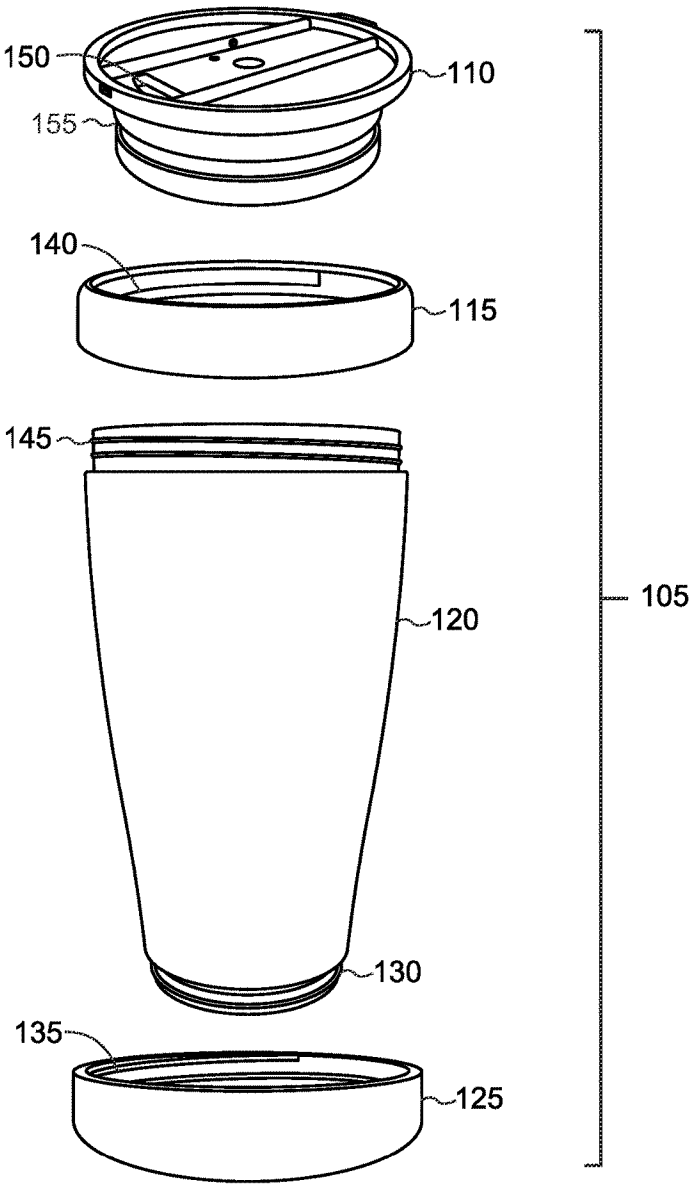
FIG. 1 shows an illustrative representation of a mug with interchangeable rims in an exploded view.

FIG. 1 shows an illustrative representation in which a tumbler mug 105 is adapted with interchangeable rims so users can alternate and customize the mug's exterior appearance on the fly. The mug includes a reservoir body 120 that holds a given beverage, such as coffee, tea, water, etc. The reservoir body may be comprised of plastic, glass, stainless steel, or other suitable material.

The reservoir body 120 has upper threads 145 and lower threads 130 that mate with corresponding threads on a top rim 115 and bottom rim 125. The top rim 115 has threads 140 on its interior surface that engages and mates with the upper threads 145, and the bottom rim 125 has threads 135 on its interior surface that engage and mate with the lower threads 135. The upper and bottom rims may be comprised of a similar material as the reservoir body, such as plastic, glass, stainless steel, etc. The rims may be comprised of or include a rubber or silicone material that provides additional support or protection to various components or provides a design alternative, such as to the rims. The reservoir body may be a distinct material from the rims as well. For example, the reservoir body may be comprised of stainless steel, and the rims may be comprised of plastic or silicone to provide greater protection to the mug's high-exposure ends. Although multiple rims and locations to secure rims are shown in the drawings, in other embodiments, a single rim and rim location on the reservoir body may be utilized, such as a bottom rim or a top rim. Alternatively, any number of rims may be used.

In alternate embodiments, the rims may be magnetized to secure to the reservoir body 120. In the magnetic implementation, the upper and lower threaded locations may be magnetized to attract to the rims and may still also be threaded, or the threads may be removed, and only the indent into the reservoir body is present to correspondingly receive the rims. The magnets in the threaded regions on the reservoir body may be encapsulated inside the body or may be partially encapsulated and partially exposed to attract with the rim's magnets. The top and bottom rims may have one or more magnets affixed inside their bodies. The magnets may extend fully around the rims or be placed in one, two, or more places around the rims, which would then mate with correspondingly located magnets on the reservoir body. For example, two magnets may be oppositely placed on the rims, which mate with two correspondingly located magnets on the rims so that the magnets attract and secure to each other.

Furthermore, should the rims be damaged in any way, such as the bottom rim from repeatedly coming into contact with surfaces, the user can throw old rims away and use new ones. Thus, not only can a user dynamically express themselves with their mug and treat their mug as another fashionable accessory, as described below, but the rims also serve to prolong the mug's life.

Once the top rim 115 is engaged to the upper threads 145, a lid 110 may attach to the interior of the reservoir body 120. Typically, the lid may be press-fitted to the top of the reservoir body and be sealed to prevent liquids from escaping. Specifically, the bottom portion 155 enters the reservoir body's cavity and then secures to the interior perimeter of the reservoir body to prevent beverages from escaping. The rims attach to an exterior portion of the reservoir body, so the top rim 115 does not interfere with the lid's attachment to the reservoir body. The lid includes an opening 150 that extends from the top to the bottom of the lid, from which liquids in the reservoir body can be dispensed.

Figure 2:
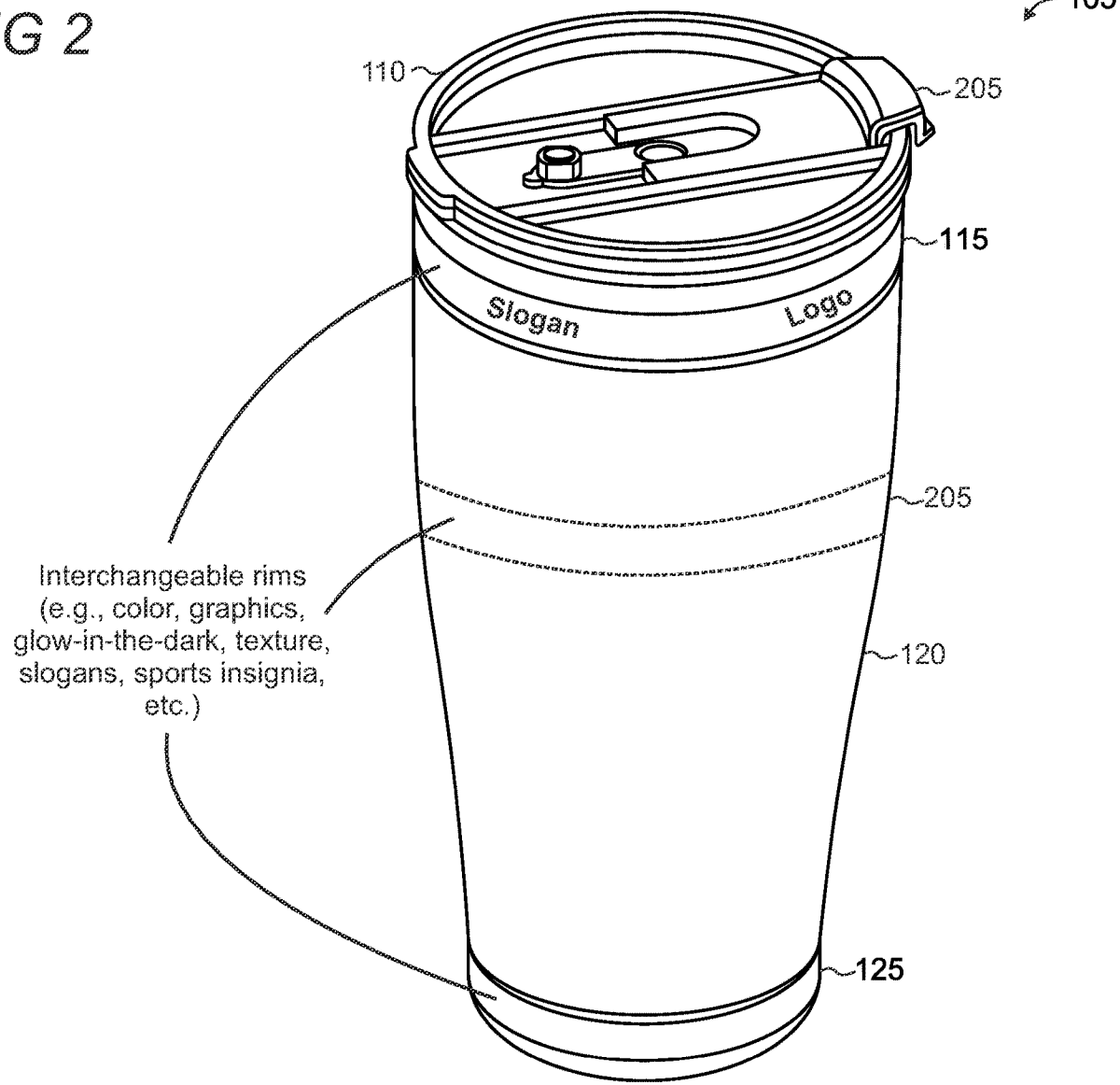
FIG. 2 shows an illustrative representation of the mug with the interchangeable rims assembled.

FIG. 2 shows an illustrative representation in which the tumbler mug 105 is fully assembled with interchangeable rims, namely top rim 115 and bottom rim 125. As shown, rims can come in a variety of designs, colors, and features. For example, the rims can be blue, red, black, grey, etc. Rims can come with slogans, sports team colors, logos, or other insignia, different textures (e.g., rugged, smooth, etc.), and glow-in-the-dark, among other designs and styles. Such customizations enable users to use a single reservoir body but customize and stylize it according to their current desires. Basically, the tumbler mug can be another accessory that the user can match to their clothing, like a watch, shoes, belt, etc. The user can choose to change their rims and style on a daily basis, weekly, or according to the season. For example, the user may flash their Yankees® rims during baseball season and their Knicks® rims during basketball season.

FIG. 2 further shows an additional rim placement 205 near a center region of the reservoir body 120 to provide even greater user customizations. The middle portion may be a small recess within the body of the mug that a user can press-fit into by directing the center rim from the bottom of the mug toward the recess. Alternatively, threads may also be present on the center recess to which a rim can be secured. In some situations, the center region's recess or threads may be adapted to a similar or the same size as the upper threads 145 so that the user can utilize the same size rims for both locations instead of having to purchase a third set of rims. While FIG. 2 shows one possible location for the middle rim, one or more middle rims may be placed anywhere between the top and bottom of the reservoir body 120. Although certain sized rims are shown in the drawings, any sized rims or reservoir bodies can be used to accommodate differently shaped mugs, cups, etc.

Figure 4:
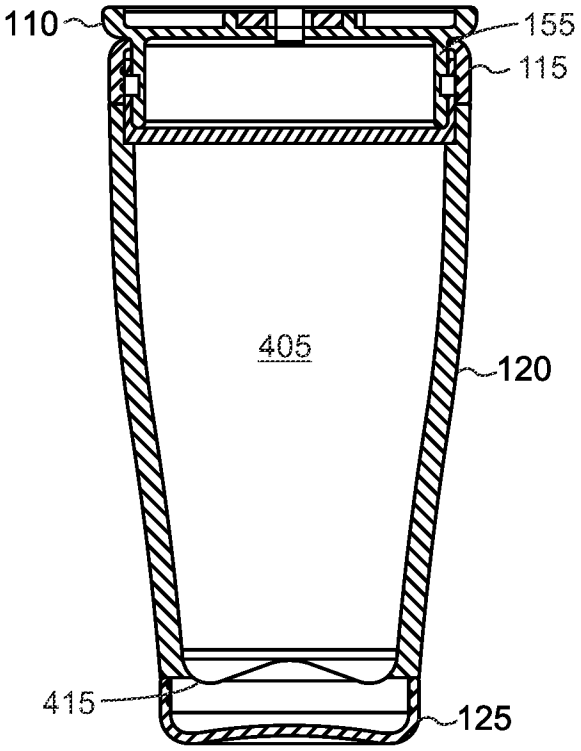
FIGS. 3 and 4 show illustrative diagrams, including a cross-section view of the mug.
Figure 3:
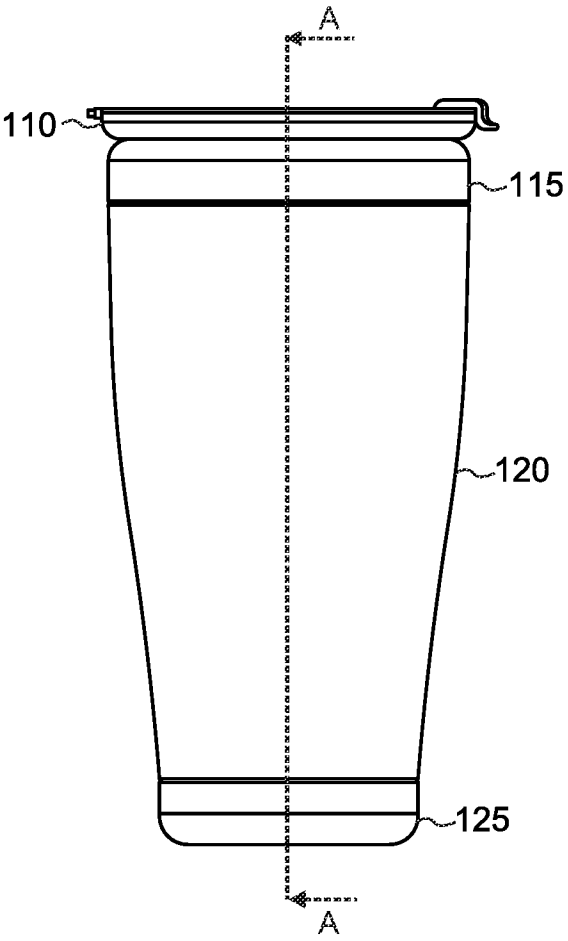

FIGS. 3 and 4 show illustrative diagrams of the tumbler mug 105; FIG. 4 is a cross-sectional diagram of section A-A shown in FIG. 3. The reservoir body includes a cavity 405 in its center to receive a beverage, such as coffee, tea, water, Gatorade®, etc. As shown in FIG. 4, the bottom portion 155 of the lid is positioned on the interior of the rim 115 and within the cavity of the reservoir body. The outer boundary of the bottom portion 155 engages and seals against the interior perimeter of the reservoir body to prevent liquid from escaping. The base 415 of the tumbler mug extends below the bottom rim 125 so that the bottom rim slightly encapsulates the bottom base 415.

Although threads are shown as the connection mechanism used herein, other methods of connection between the rims and reservoir body are also possible, such as a press-fit mechanism, tab and notch, locking mechanism that releases at the press of a button, etc.

Figure 7:
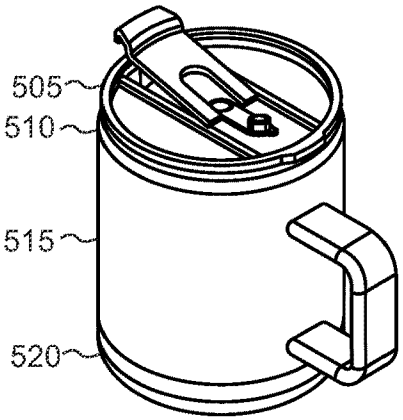
FIGS. 5-7 show illustrative representations of various alternate design implementations of a mug with interchangeable rims.
Figure 6:
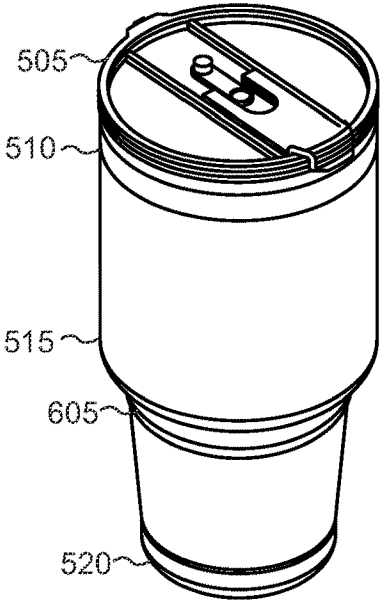
Figure 5:
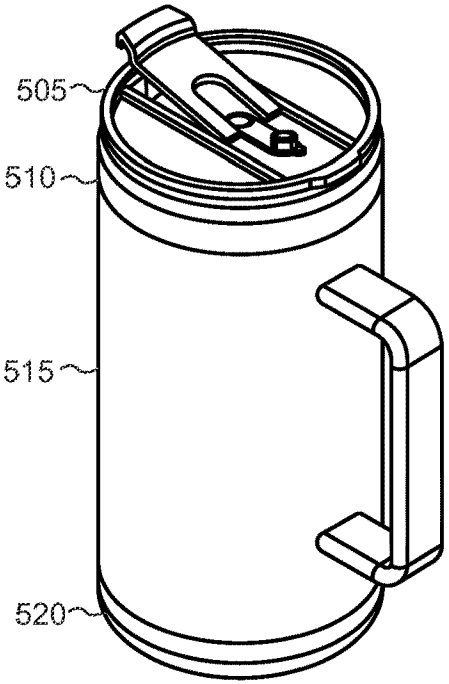

FIGS. 5-7 show illustrative representations of various design implementations of the present mug with interchangeable rims. For example, mugs can be of different sizes, widths, lengths, with or without a handle, different reservoir body designs, etc. Thus, while various types and styles of mugs can be used, the interchangeable rim concept is implemented similarly regardless. FIGS. 5-7 are each configured with a lid 505, reservoir body 515, a top rim 510 that secures to upper threads (not shown) on the reservoir body, and a bottom rim 520 that secures to lower threads (not shown) on the reservoir body. Each component may be configured similarly to like components described above with respect to the tumbler mug 105.

FIG. 6 further shows a mid-rim 605 positioned between the top and bottom rims 510 and 520. Similar to the additional rim 205 shown in FIG. 2, the mid-rim 605 can provide the user with an additional opportunity to customize and re-design their mug. The reservoir body may have a recess into which a rim press fits or may have threads that a rim secures via rotational manipulation. The mid-rim may be angled to secure to the angled portion of the reservoir body shown in FIG. 6 or straight for bodies shown in FIGS. 2, 5, and 7.

Various embodiments are discussed herein. In one exemplary embodiment is a mug with interchangeable rims, comprising: a reservoir body having upper threads; a top rim having interior threads that engage with the reservoir body's upper threads exposed on an exterior of the reservoir body; and a lid that engages with an interior portion of the reservoir body, in which the interior portion is on a side opposite of the exterior upper threads.

As another example, further comprising: lower threads on the reservoir body; and a bottom rim having interior threads that engage with the reservoir body's lower threads. In another example, further comprising multiple sets of top rims and bottom rims that are interchangeable with the respective upper and lower threads, in which the multiple sets of top and bottom rims each have distinct designs. In another example, the distinct designs include different sports team insignia, colors, glow-in-the-dark capabilities, or texture. As another example, further comprising a recess on the reservoir body between the upper and lower threads, in which the recess receives a rim. As another example, a bottom portion extends from the lid, and the bottom portion engages and seals against an interior surface of the reservoir body.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed:

1. A mug with interchangeable rims, comprising:

a reservoir body having upper threads exposed on an exterior of the reservoir body;

a top rim having interior threads that engage with the reservoir body's upper threads, wherein the top rim is positioned at a top end of the reservoir body and represents an uppermost portion of the reservoir body, the top rim being curved at its upper end; and a lid that engages with an interior portion of the reservoir body, in which the interior portion is on a side opposite of the exterior upper threads, and wherein at least a portion of the lid, the reservoir body's upper threads, and the top rim's interior threads are horizontally aligned with each other.

2. The mug with interchangeable rims of claim 1, further comprising:

lower threads on the reservoir body; and a bottom rim having interior threads that engage with the reservoir body's lower threads.

3. The mug with interchangeable rims of claim 2, further comprising multiple sets of top rims and bottom rims that are interchangeable with the respective upper and lower threads, in which the multiple sets of top and bottom rims each have distinct designs.

4. The mug with interchangeable rims of claim 3, wherein the distinct designs include different sports team insignia, colors, glow-in-the-dark capabilities, or texture.

5. The mug with interchangeable rims of claim 4, further comprising a recess on the reservoir body between the upper and lower threads, in which the recess receives a rim.

6. The mug with interchangeable rims of claim 1, wherein a bottom portion extends from the lid, and the bottom portion engages and seals against an interior surface of the reservoir body.

* * * * *